US005990054A

United States Patent [19]

Willis

[11] Patent Number: 5,990,054

[45] Date of Patent: Nov. 23, 1999

[54] METHOD OF MIXING DIETHYLENE GLYCOL AND POLYTETRAFLUOROETHYLENE

[76] Inventor: John Dale Willis, 1222 Merlyn St., Lakeland, Fla. 33813

[21] Appl. No.: 09/224,661

[22] Filed: Dec. 31, 1998

Related U.S. Application Data

[60] Provisional application No. 60/070,169, Dec. 31, 1997.

[51] Int. Cl.[6] ..... C10M 131/04

[52] U.S. Cl. ..... 508/182; 508/183

[58] Field of Search ..... 508/181, 182, 508/183

[56] References Cited

U.S. PATENT DOCUMENTS

| | | | |
|---|---|---|---|
| 4,224,173 | 9/1980 | Reick | 508/182 |
| 4,615,917 | 10/1986 | Runge | 508/183 |
| 4,806,281 | 2/1989 | Huth | 508/181 |
| 5,518,639 | 5/1996 | Luk et al. | 508/182 |

*Primary Examiner*—Jacqueline V. Howard
*Attorney, Agent, or Firm*—Lyon, P.C.

[57] ABSTRACT

A lubricant contains a fire-resistant water/glycol mixture combined with polytetrafluoroethylene, and is useful in the hydraulic systems of die casting machines, for example. The addition of polytetrafluoroethylene enhances the lubricity of fire-resistant hydraulic fluids thereby reducing the associated equipment maintenance. A preferred lubricant is formed by sequentially and homogeneously blending its constituents thereby prolonging the shelf life of the final product.

4 Claims, No Drawings

METHOD OF MIXING DIETHYLENE GLYCOL AND POLYTETRAFLUOROETHYLENE

CROSS REFERENCE TO RELATED APPLICATIONS

This application claims the benefit of United States Provisional Application Ser. No. 60/070,169 filed on Dec. 31, 1997.

FIELD OF THE INVENTION

This invention relates to a fire-resistant lubricant designed for use within high temperature environments such as die casting machines.

BACKGROUND OF THE INVENTION

In many industrial forming processes, such as the molding, die casting, drawing, and forging of various metals or other similar materials, it is necessary to apply a lubricant to the working surfaces of such dies or other forming apparatus between machine-cycle operations. Further, the application of air and lubricants to the working surfaces tends to cool the dies between operational cycles thereby prolonging the life of the dies.

Industrial processes such as die casting often subject hydraulic systems to extremely high temperatures. In the past, many die casting operations used well-known hydraulic fluids as lubricants, despite their flammability. Given the safety considerations, conventional hydraulic fluids within high temperature hydraulic applications were replaced with nonflammable water/diethylene glycol or water/ethylene glycol mixtures. Although nonflammable, water glycol mixtures exhibit poor lubricity properties thereby resulting in equipment failure and escalating maintenance costs due to friction wear.

Conventional fixed and movable die casting molds are substantially formed from heat resistant metal. In a typical die casting process, a piston slidably moves within an injection sleeve causing molten metal contained therein to be injected and filled into a mold assembly. Over time, the hydraulic equipment and molds sustain repeated thermal shocks caused by heat transfer from the hot molten metal often ranging from about 600 to 1650 degrees Celsius. In the absence of an effective lubricant, the molds rapidly erode and fracture resulting in a complete crack or breakage. The hydraulic equipment is subject to the same lubricant. Properties such as the tensile strength and fatigue-resistance are detrimentally affected thereby reducing the life of the equipment.

The surfaces of the die cast molds typically require maintenance after several cycles since the surfaces gradually wear out through constant use. When maintenance is required, the entire die cast frame must be disassembled to facilitate removal of the molds. This is typically a very time-consuming operation resulting in an idle production line. The time spent to maintain the die therefore reduces the production time.

It would therefore be an improvement to provide a fire-resistant fluid having enhanced lubricating and cooling properties.

SUMMARY OF THE INVENTION

The present invention solves the aforesaid problems by forming an industrial fluid useful as a hydraulic and/or lubricating fluid, wherein the industrial fluid contains a lubricating additive combined with nonflammable water/glycol mixtures. The lubricating additive includes water/glycol fluids blended with an aqueous solution of polytetrafluoroethylene (hereinafter PTFE). PTFE is generally provided as either a granular, micropowder, or aqueous substance. Applicant has further discovered that due to its higher density, the PTFE aqueous solution when compared to granular or powdered PTFE, forms a denser and more effective lubricant between opposing interfaces.

In accordance with the present invention, a preferred embodiment comprises aqueous PTFE containing 50–60% PTFE and 33–50% water, wherein the aqueous PTFE constitutes about 0.2 to 5% by weight of the total lubricant. The preferred lubricating additive further contains, in weight percentages, a glycol-based fire-resistant fluid at about 75–95%, a dispersant at about 2–10%, a first surfactant at about 2–12%, a second surfactant having nonionic character at about 0.25–6%, and a defoaming agent at about 0.1–4%.

DESCRIPTION OF THE PREFERRED EMBODIMENT(S)

In accordance with the present invention, a fire resistant water/glycol fluid is mixed with PTFE thereby resulting in a fire-resistant lubricant to be added to a bulk water/glycol hydraulic fluid. The composition also contains a surface active agent functioning as a dispersant and a wetting agent, and if desired, may contain a first surfactant, a second nonionic surfactant, and a defoaming agent.

The water/glycol fluid generally contains a glycol-based fluid at about 40–60% by weight, and water at about 40–60% by weight. The glycol-based fluid includes but is not limited to a fluid selected from diethylene glycol or ethylene glycol.

In accordance with the present invention, polytetrafluoroethylene is added to significantly improve the lubricity properties of the hydraulic fluid. Polytetrafluoroethylene is commercially available as a granulated solid, a powdered solid, and as an aqueous dispersion. When aqueously dispersed, PTFE constitutes about 50–60% of the aqueous dispersion, and water constitutes 33–50% of the aqueous dispersion. In further accordance with the present invention, applicant has discovered that the use of aqueous PTFE results in better mixing of the suspended PTFE and therefore enhances the lubricity of the final product. Stated another way, the particle size of the suspended PTFE in the aqueous dispersion is significantly smaller than that of the micropowder type. In the aqueous dispersion, PTFE particles range in size from 0.05 to 0.5 microns. As a micropowder, the average size of the PTFE particles is about 2 microns. The smaller particles within the aqueous dispersion more readily fill the vacant interstices of the molecular matrices when mixed with the hydraulic fluid. As a result, mixing aqueous PTFE into the hydraulic fluid results in a denser lubricant as compared to the granulated and powdered PTFE. However, one of ordinary skill in the art will readily appreciate that mixing in powdered or granulated PTFE will still provide enhanced lubricating properties within the hydraulic fluid. The aqueous PTFE solution, comprising 50–60% of suspended PTFE, is provided at about 0.2–5% by weight of the total lubricant. Therefore, when adding solid PTFE, the total amount should constitute at least 0.1–3% by weight of the total lubricant. If desired, the solid PTFE may constitute up to 3–10% by weight and may be added to account for the reduction in PTFE density as described above.

The dispersant, the first surfactant, and the second nonionic surfactant are each selected from well-known additives useful as surface active agents. These include suspending agents, dispersing agents, wetting agents, and emulsifying agents. Surface active agents, often multifunctional, are employed in the aqueous system to assist in wetting the operating surfaces of the applicable equipment. They are also used to disperse, suspend, or emulsify water insoluble components, such as PTFE, and to evenly apply the lubricant to the equipment operating surfaces. Many examples of surface active agents of each type are disclosed in McCutcheons's *Detergents and Emulsions.* 1982, incorporated herein by reference. U.S. Pat. No. 4,454,050, incorporated herein by reference, also discloses examples of surface active agents. A surface active agent, useful in homogeneously dispersing the PTFE throughout the hydraulic fluid, is also selected based on its respective wetting, suspending, and emulsifying properties. Triethanolamine, for example, is known for its use as a dispersant, a chelating agent, an emulsifier, and as a detergent or wetting agent. Notwithstanding the multifunctional properties of a surface active agent such as triethanolamine, preferred lubricants of the present invention include additional surfactants and a defoaming agent as described below.

Other additives such as thickeners, germicides, corrosion inhibitors, dyes, and perfumes may be added as taught in U.S. Pat. No. 4,454,050.

In general, the lubricants may be formulated as follows. A vessel equipped with a stirrer and with either internal or exterior heating and cooling is preferred. Stainless steel is a preferred metal for the mixing vessel. The vessel is first charged with the water/glycol hydraulic fluid. Next, the dispersant or surface active agent is slowly and homogeneously added. If desired, the first surfactant is next slowly and homogeneously added. Again, if desired, the second nonionic surfactant is slowly and homogeneously added. Next, the polytetrafluoroethylene is slowly and homogeneously added. Finally, if desired, the defoaming agent is slowly and homogeneously added. Other additives such as thickeners, germicides, corrosion inhibitors, dyes, and perfumes may then be added if desired. While mixing the ingredients, the temperature is allowed to rise to its natural level, and, if necessary heat is applied to facilitate more efficient mixing.

Specifically, a preferred lubricant may be formed by slowly, homogeneously, and sequentially mixing the following compounds in the order and weight percentage ranges (of the total lubricant) given:

| Compounds | Wt. % Range |
|---|---|
| about 40 wt. % diethylene glycol admixed with about 45 wt. % water as a water/glycol fluid; | 75% to 95% |
| triethanolamine as a dispersant; | 2% to 10% |
| oleyl alcohol polyethoxylate, phosphate ester as a first surfactant; | 2% to 12% |
| octylphenoxypolyethoxyethanol as a second nonionic surfactant; | .25% to 6% |
| about 60 wt. % PTFE admixed with about 33 wt. % water; | .2% to 5% |
| about 6 wt. % polypropylene glycol admixed with about 2 wt. % polydimethylsiloxane and about 90 wt. % water as a defoaming agent. | .1% to 4% |

As a further object of the present invention, the shelf life of the preferred lubricants may be significantly prolonged if the lubricant is formulated by the method and sequence described below.

A primary vessel and a secondary vessel are preferably equipped with a stirrer and with either internal or exterior heating and cooling. Stainless steel is a preferred metal for both mixing vessels. For illustrative purposes, a basis of 100 pounds of a final product is assumed. The percentage ranges of the constituents listed in the preferred lubricant given above are incorporated within this method. The primary vessel is first charged with the water/glycol hydraulic fluid. While blending, the dispersant or surface active agent, such as triethanolamine, is then slowly added and homogeneously blended. Next, a first surfactant, such as oleyl alcohol polyethoxylate, phosphate ester, is slowly and homogeneously blended into the primary tank. The term "slowly" as used throughout the mixing method refers to a mass transfer flow rate of approximately 0.1 to 50.0 pounds per minute noting a final product mass of 100 pounds. Stated another way, the definition of a "slow" mass transfer flow rate is approximately 0.1 to 50% of the final product mass per minute. The lubricants may be mixed more rapidly, however, the quality of the lubricants may be reduced. An even color throughout the mixture is indicative of a "homogeneous" blend.

Next, about 10–15% of the existing blend within the primary vessel is slowly transferred, by air pump or gravity feed for example, into the secondary blending vessel. Next, about 20–25% of the total amount of a second nonionic surfactant to be added, such as octylphenoxypolyethoxyethanol, is slowly added to the secondary vessel and then homogeneously blended. Next, slowly pour the remaining 75–80% of the total second nonionic surfactant in the primary blending tank and homogeneously blend. Continue to blend both tanks.

Next, slowly add an aqueous solution of PTFE, described hereinabove, into the secondary vessel and homogeneously blend into a slurry. Then slowly transfer the slurry from the secondary tank into the primary tank while blending the contents. Homogeneously blend. Next, if desired, slowly add a defoaming agent into the primary tank and homogeneously blend for about ten minutes. Then stop all blending for five minutes.

Next, if additional blending is desired for an even better consistency, blend for another ten to fifteen minutes and then stop all blending for five to ten minutes. Again, blend for another ten to fifteen minutes and then stop all blending for five to ten minutes. Once again, blend for another ten to fifteen minutes. The mixture is then ready for use.

Slowly transfer the finished product into storage containers such as 55-gallon drums or totes.

The constituents of the lubricants of the present invention may be purchased from suppliers well known in the art. The water/glycol fluid may be purchased, for example, under the trade name of "HOUGHTO-SAFE 419-R" from Houghton International Inc. of Valley Forge, Pa. The triethanolamine may be purchased, for example, from Ashland Chemical Co. of Colombus, Ohio. The oleyl alcohol polyethoxylate, phosphate ester may be purchased, for example, under the trade name of "LUBRHOPHOS LB-400" from Ashland Chemical Co. of Colombus, Ohio. The octylphenoxypolyethoxyethanol may be purchased, for example, under the trade name "TRITON X-100" from Union Carbide Corporation of Danbury, Conn. The aqueous solution of PTFE may be purchased, for example, under the trade name of "TEFLON 30" from E.I. Dupont of Wilmington, Del. Finally, the antifoam agent may be purchased, for example, under the trade name "DOW CORNING(R) ANTIFOAM 2210" from Dow Corning Corporation of Midland, Mich.

After mixing is complete, the lubricating additive is now suitable for ultimate mixing with a water/glycol hydraulic fluid useful within a die casting machine, for example. The lubricating additive is generally mixed at about one part of additive to twelve parts of water/glycol hydraulic fluid, but may be tailored based on performance criteria. The addition of the PTFE lubricant has been found to significantly reduce friction and therefore prolong the life of the hydraulic cylinders and pumps. Furthermore, the energy required to operate the hydraulically actuated equipment is significantly reduced when the PTFE lubricant is added.

While the preferred embodiment of the invention has been disclosed, it should be appreciated that the invention is susceptible of modification without departing from the scope of the following claims.

I claim:

1. A method of formulating a lubricant comprising the steps of:

charging a primary vessel with a water/glycol hydraulic fluid;

adding a dispersant to the primary vessel and homogeneously blending the mixture;

adding a first surfactant to the primary vessel and homogeneously blending the mixture;

transferring 10–15% of the mixture containing the first surfactant into a second vessel;

adding a fraction of a second nonionic surfactant into the second vessel and homogeneously blending the mixture, wherein the fraction is approximately 20–25% of the total amount of the second nonionic surfactant to be added when formulating the lubricant;

adding the remaining fraction of the second nonionic surfactant into the primary vessel and homogeneously blending the mixture, wherein the remaining fraction is approximately 75–80% of the total amount of the second nonionic surfactant to be added when formulating the lubricant;

adding an aqueous solution of polytetrafluoroethylene into the second vessel and homogeneously blending into a slurry; and transferring the slurry within the second vessel into the primary vessel and homogeneously blending.

2. The method of claim 1, following the step of transferring the slurry from the second vessel to the primary vessel, further comprising the steps of:

homogeneously blending for about 10–15 minutes and then cease all blending for about 5–10 minutes;

homogeneously blending for another 10–15 minutes and then cease all blending for about 5–10 minutes; and homogeneously blending for another 10–15 minutes.

3. The method of claim 1 further comprising the step of:

adding a defoaming agent into the primary vessel and homogeneously blending, wherein the addition of the defoaming agent immediately follows the transfer of the slurry from the second vessel into the primary vessel.

4. The method of claim 1 wherein:

the dispersant is triethanolamine;

the first surfactant is oleyl polyethoxylate, phospate ester; and the second nonionic surfactant is octylphenoxypolyethoxyethanol.

* * * * *